United States Patent [19]

Schultz

[11] Patent Number: 4,556,395

[45] Date of Patent: Dec. 3, 1985

[54] COLLAPSIBLE SHIP AND MODEL KIT

[76] Inventor: James D. Schultz, 19 N. Adelaide Ave., Highland Park, N.J. 08904

[21] Appl. No.: 577,214

[22] Filed: Feb. 6, 1984

[51] Int. Cl.[4] ..... A63H 23/02; A63H 27/02

[52] U.S. Cl. ..... 446/160; 446/88

[58] Field of Search ..... 446/6, 85, 86, 87, 88, 446/93, 160, 163, 102, 104, 153, 154, 156; D21/109, 130; 114/102, 111, 103

[56] References Cited

U.S. PATENT DOCUMENTS

| | | | |
|---|---|---|---|
| 16,890 | 3/1857 | Trescot | 114/103 |
| 44,065 | 9/1864 | Baxter, et al. | 114/103 |
| D. 84,160 | 5/1931 | Nowakowski | D21/130 X |
| 143,568 | 10/1873 | Freeman | 114/103 |
| 1,376,170 | 4/1921 | Shann | 114/111 X |
| 1,642,716 | 9/1927 | Bentzen | 114/102 |
| 2,034,535 | 3/1936 | Platt | 446/87 X |
| 2,545,706 | 3/1951 | Rosenberg | 446/160 |
| 2,680,921 | 6/1954 | Gowland | 446/160 X |
| 2,730,827 | 1/1956 | Patterson | 446/88 |

*Primary Examiner*—Robert A. Hafer
*Assistant Examiner*—D. Neal Muir
*Attorney, Agent, or Firm*—Robert A. Green

[57] ABSTRACT

A ship suitable for mounting in a bottle comprising a hull having a generally horizontal deck, a plurality of masts, a plurality of yards on each mast, openings in the deck, each of which is shaped to receive the end of one of the masts and in which the end of the mast is pivotably seated to permit the masts to be raised from a lowered horizontal position. A plurality of rigging lines extend from spaced locations on each mast downwardly laterally to be secured to the outside of the hull on both sides thereof, a plurality of lines extend from yards on one mast to a yard on the mast behind it, and a plurality of lines extend from the leading mast through openings in the ship bowsprit, and these lines are used to raise the masts when the ship is in a bottle.

7 Claims, 8 Drawing Figures

COLLAPSIBLE SHIP AND MODEL KIT

BACKGROUND OF THE INVENTION

Toy ships and ships in bottles have been known for many years. One patent, U.S.P. No. 2,730,827, discloses a ship in a bottle arrangement of the general type contemplated by the present invention. However, the present invention has structural features which are not found in this prior art, and these features provide improvement in building ships in bottles. The invention particularly lends itself to kit form for the hobbyist.

DESCRIPTION OF THE INVENTION

Figure 4:
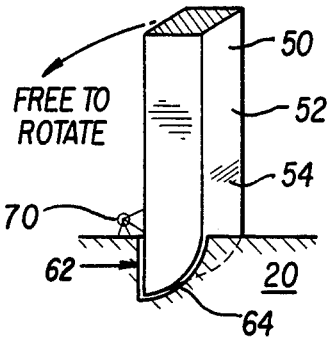
FIG. 4 is a perspective view of a portion of the ship of the invention.
Figure 7:
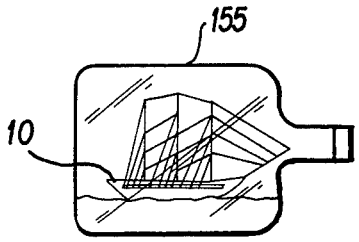
FIG. 7 is a side elevational view of the ship of FIG. 1 in a bottle.

The toy ship of the invention 10 includes a hull 20 having a deck 30 and including a bowsprit 40 which extends from the front end of the hull. The bowsprit may be in the form of a pole or post or the like and includes a transverse post 44 at about the center of the bowsprit, and a post 46 which extends downwardly from about the center of the bowsprit. The illustrated embodiment of the invention includes three masts 50, 52, 54, which, according to the invention, have their lower ends pivotably seated in depressions or openings 60 in the deck. In one arrangement, each of these openings 60 has a vertical rear wall 62, and a curved front wall 64 (FIG. 4), these two walls matching generally the curvature of the lower ends of the masts which are inserted therein.

A hinge 70 made up of a length of string, leather, or the like is secured to the deck 30 and the rear surface of each mast. Each mast is provided with a plurality of yards; four per mast are used in the present invention which extend horizontally and are spaced apart from the top to the bottom of each mast. The yards 80-91 increase in length from top to bottom of each mast. Sails, of paper or cloth (not shown), may be attached to the yards.

The rigging for the ship 10 includes a first line 100 which extends from beneath the bowsprit through a hole in the bowsprit near the leading end thereof and extends to the top of each mast. The line 100 is slidably seated in a slot in the first mast 50 and second mast 52 and is glued or otherwise secured to the top of the third mast 54. A plurality of similar lines 102, 104, 106 extend through spaced holes in the bowsprit and are threaded through small holes in the mast 50 near the yards and are secured to the rear of the mast by gluing or the like. A line 108 extends slidably across the lowermost yard 83 at its junction with the front mast 50 and extends on either side downwardly to the side of the hull. The two ends of this line are secured to the sides of the hull by gluing or the like and by means of a securing strip 98 extending along the length of the hull on each side thereof. This line is free to slide with respect to the mast 50, and it is drawn rearwardly from the mast at a small angle to the vertical. Similar lines 109–119 extend from one side of the hull to the other across each of the yards on each of the masts. These lines are also disposed at a small angle to the vertical, and their ends are secured to the hull under the strips 98.

Another group of lines interconnects the yards and includes two lines 120 which extend between the outermost portions of yards 82 and 87, two lines 122 which extend between the outermost portions of yards 81 and 86, two lines 124 which extend between the outermost portions of yards 80 and 85, two lines 126 which extend between the outermost portions of yards 86 and 91, two lines 128 which extend between the outermost portions of yards 85 and 90, and two lines 130 which extend between the outermost portions of yards 84 and 89.

A line 140 extends from the leading end of the bowsprit to the end of the vertical post 46 and connected to horizontal crossbar 150, and two lines 142 and 144 extend rearwardly to the ends of a crossbar 150 at the front of the hull. Similarly, lines 146 and 148 run from the leading end of the bowsprit to the ends of the crossbar 44 and thence to the ends of crossbar 150. A spring 153 is secured to the second mast 52, for a purpose to be described.

Figure 1:
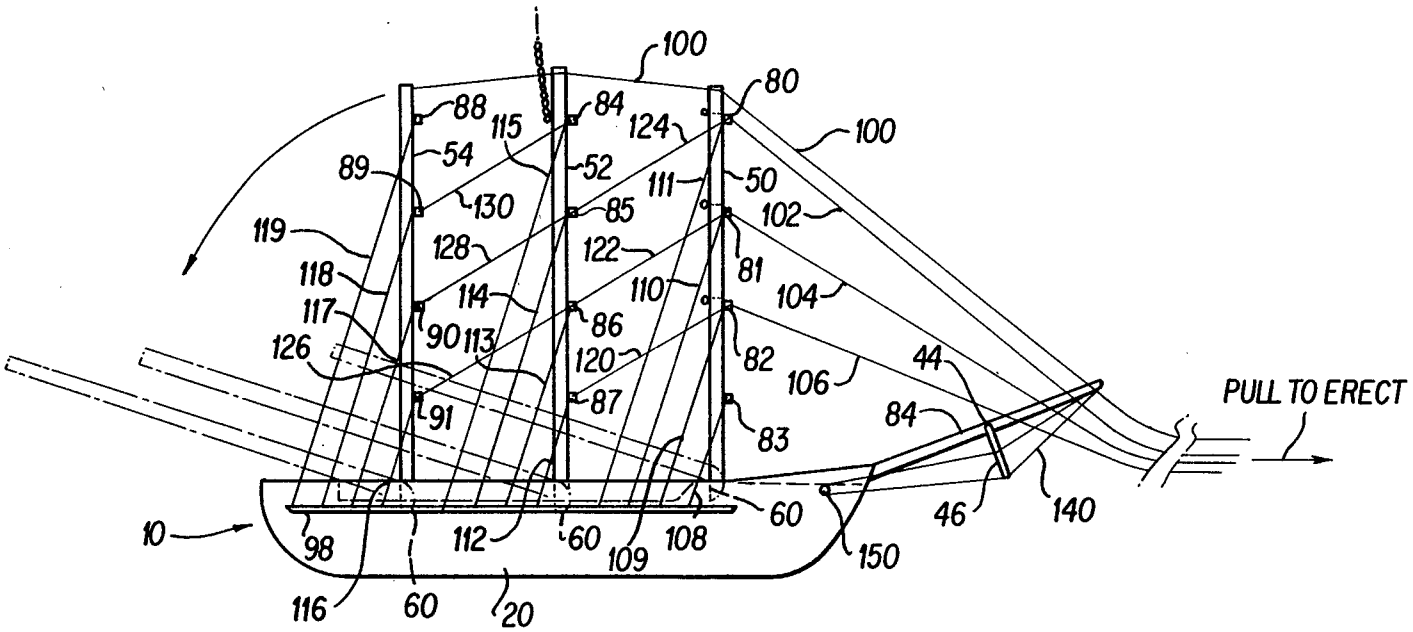
FIG. 1 is a side elevational view of a collapsible ship embodying the invention.
Figure 3:
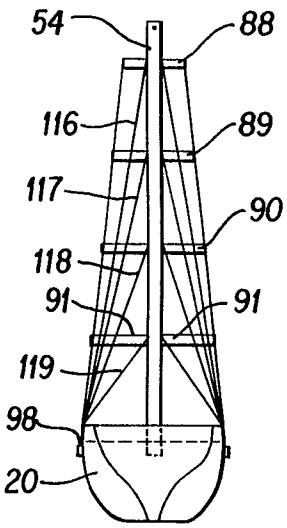
FIG. 3 is a rear view of the ship of FIG. 1.
Figure 2:
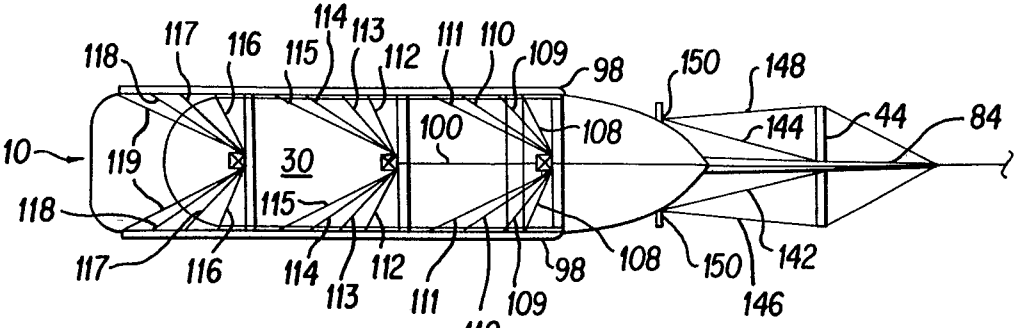
FIG. 2 is a plan view of the ship of FIG. 1.
Figure 6:
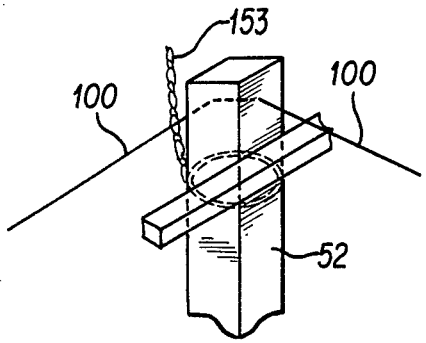
FIG. 6 is a perspective view of another portion of the ship of the invention.
Figure 5:
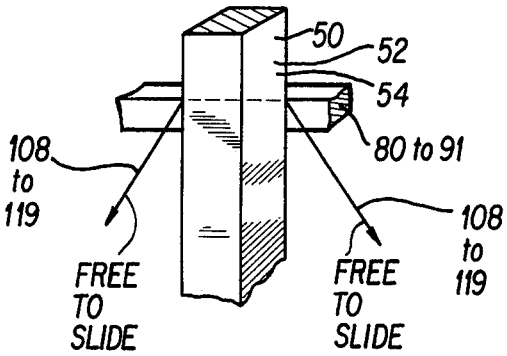
FIG. 5 is a perspective view of another portion of the ship of the invention.
Figure 8:
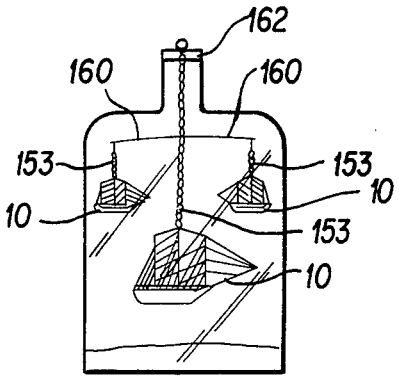
FIG. 8 is a side elevational view of a bottle containing a plurality of ships of the invention.

In using the apparatus of the invention, all of the parts are assembled as described, and the masts are pivoted downwardly to the left, shown in dash lines in FIG. 1. The ship is then inserted in a bottle 155 or light bulb or other narrow-necked, transparent container to the desired position, set in clay, putty, or the like, and then the lines 100, 102, 104 and 106 are pulled to the right to raise the masts to their upright positions. The lines are then attached to the bowsprit, and the excess removed by cutting, and the assembly is complete.

In another mode of displaying ships 10, a plurality of ships may be coupled to a rod 160 to form an assembly like a mobile, and the rod 160 is coupled by string 153 to the stopper 162 of the bottle.

The ship 10 and its structural features have many advantages, and the assembly is particularly suited for operation as a kit for building ships in bottles. The principles of the invention can be employed with ships of different sizes in which the same general principles are used but in which more or fewer of the parts described may be employed. The invention particularly has the advantage that, while the ship is relatively easy to assemble and mount in a narrow-necked transparent container, it looks professional.

As to specific structural features which are particularly advantageous:

1. The rigging that utlimately supports the mast in its vertical position, lines 109–119, is tied from the outside of the hull, across the yard, and down to the outside of the hull. This provides greater lateral stability when the masts are in their erected position.

2. The masts are connected to each other by means of inelastic rigging, lines tied from "yard to yard" 102–130. This provides greater longitudinal stability when the masts are in their erected position.

3. The base of each mast is connected to the deck by means of a hinge 70. The mast's rotation is restrained by the "yard to yard" rigging 120–130.

4. When the masts are erected to their vertical position, only the forward mast is pulled directly. The "yard to yard" rigging forces the middle mast to follow the forward mast into its vertical position.

5. The bowsprit is sufficiently rigged and tied, to support the tension of the longitudinal rigging 100, 102, 104, 106.

What is claimed is:

1. A ship assembly for mounting a bottle comprising
a hull having a generally horizontal deck;
a plurality of masts spaced apart along said deck from front to rear thereof;
a plurality of horizontal yards secured to each mast and spaced apart along each mast;
openings in said deck, each of which is shaped to complement the shape of the end of a mast and to receive the end of one of said masts and in which the end of the received mast is pivotably seated;
a plurality of non-elastic rigging lines secured at their ends to the outside of the hull and extending from one side of the hull across a mast where a yard is secured to the other side of the hull, there being one rigging line associated with each yard on each mast;
a plurality of non-elastic yard lines, each extending from the end of a yard on one mast to the end of a yard on the mast behind it;
a bowsprit; and
a plurality of non-elastic lines extending through openings in the bowsprit, with several lines secured to the first mast where yards are secured thereto and one line contacting the tops of all of the masts and secured to the tops of the sternmast mast;
the lower ends of the masts and said openings in said deck being shaped to permit said masts to pivot toward the rear of the hull to collapse the ship assembly and to permit it to be inserted into a bottle, whereupon the said last-mentioned lines, which extend through the bowsprit, may be pulled forwardly to rotate the masts forwardly to raise them and to place the ship assembly in display position.

2. The apparatus defined in claim 1 wherein said rigging lines are secured to the outside of the hull by a horizontal securing strip.

3. The ship assembly defined in claim 1 wherein there are at least three masts spaced apart from front to rear of said deck.

4. The ship assembly defined in claim 1 wherein said one of said last-mentioned lines is slidably seated in slots in the tops of said first and second masts.

5. The ship assembly defined in claim 1 wherein a plurality of said yards have yard lines extending from their ends to the ends of yards on the mast behind them and below them so that, when said yard lines are seen from a side of the hull, they slope downwardly from one yard to the yard behind, with the yard lines appearing to slope at about the same angle parallel to each other.

6. The ship assembly defined in claim 5 wherein there are first, second, and third masts from front to rear on said deck, and each mast carries first, second, third, and fourth yards in order, with the first yard being near the top of the mast in each case; all of the first yards being generally horizontally aligned, all of the second yards being generally horizontally aligned, all of the third yards being horizontally aligned, and all of the fourth yards being generally horizontally aligned; the first, second, and third yards on the first mast being connected by yard lines to the second, third, and fourth yards on the second mast, and the first, second, and third yards on the second mast being connected by yard lines to the second, third, and fourth yards on the third mast.

7. A ship assembly for mounting a bottle comprising
a hull having a generally horizontal deck;
a plurality of masts spaced apart along said deck from front to rear thereof;
a plurality of horizontal yards secured to each mast and spaced apart along each mast;
openings in said deck, each of which is shaped to complement the shape of the end of a mast and to receive the end of one of said masts and in which the end of the received mast is pivotably seated;
a plurality of rigging lines secured at their ends to the outside of the hull and extending from one side of the hull across a mast where a yard is secured to the other side of the hull, there being one rigging line associated with each yard on each mast;
a plurality of yard lines, each extending from the end of a yard on one mast to the end of a yard on the mast behind it;
a bowsprit; and
a plurality of lines extending through openings in the bowsprit, with several lines secured to the first mast where yards are secured thereto and one line contacting the tops of all of the masts and secured to the tops of the third mast;
the lower ends of the masts and said openings in said deck being shaped to permit said masts to pivot toward the rear of the hull to collapse the ship assembly and to permit it to be inserted into a bottle, whereupon the said last-mentioned lines, which extend through the bowsprit, may be pulled forwardly to rotate the masts forwardly to raise them and to place the ship assembly in display position.

* * * * *